US006605240B2

(12) United States Patent
Hambelton

(10) Patent No.: US 6,605,240 B2
(45) Date of Patent: Aug. 12, 2003

(54) OVER THE TOP HINGED CONCRETE FORM AND METHOD OF USING THE SAME

(75) Inventor: John J. Hambelton, Denton, TX (US)

(73) Assignee: Symons Corporation, Des Plaines, IL (US)

( * ) Notice: Subject to any disclaimer, the term of this patent is extended or adjusted under 35 U.S.C. 154(b) by 50 days.

(21) Appl. No.: 09/788,207

(22) Filed: Feb. 16, 2001

(65) Prior Publication Data

US 2002/0011045 A1 Jan. 31, 2002

Related U.S. Application Data

(60) Provisional application No. 60/183,488, filed on Feb. 18, 2000.

(51) Int. Cl.[7] ..... E04G 11/00

(52) U.S. Cl. ..... 264/33; 249/21; 249/33; 249/171; 249/170; 264/31; 264/219; 52/742.14

(58) Field of Search ..... 52/742.14, 745.11, 52/745.14; 249/33, 21, 74, 121, 136, 170, 171, 172, 188, 189, 210; 264/31, 33, 219

(56) References Cited

U.S. PATENT DOCUMENTS

| | | | | |
|---|---|---|---|---|
| 1,116,352 A | * | 11/1914 | Gates | 249/11 |
| 3,959,423 A | | 5/1976 | Boyd | |
| 4,034,957 A | | 7/1977 | Cody | |
| 4,177,968 A | | 12/1979 | Chapman | |
| 4,463,925 A | * | 8/1984 | Schimmel | 249/11 |
| 4,798,037 A | | 1/1989 | Collins | |
| 5,562,845 A | | 10/1996 | Miller et al. | |
| 5,707,539 A | | 1/1998 | Flathau et al. | |

* cited by examiner

*Primary Examiner*—Carl D. Friedman
*Assistant Examiner*—Jennifer I. Thissell
(74) *Attorney, Agent, or Firm*—Wood, Herron & Evans, LLP; Thomas W. Flynn

(57) ABSTRACT

A concrete form has a pair of opposed upstanding and spaced apart side panels. A space is defined between the side panels. Each side panel has a respective upper edge and a respective lower edge whereby a top opening is defined between the upper edges and a bottom opening is defined between the lower edges. At least one bottom soffit panel is coupled to the form and is movable between a first soffit position closing off the bottom opening and a second soffit position providing access to the space through the bottom opening. At least one transverse top beam is coupled to the form and is movable between a first top beam position across the top opening and a second top beam position providing access to the space through the top opening. A method of setting up the concrete form includes assembling the form, opening the top beam if closed, installing at least one steel reinforcing element within the forming space through the top opening, and closing and securing the top beam. The form can be assembled on the ground and then placed in position or can be assembled in position to form a concrete structure. The steel reinforcement can be added either on the ground or with the form in position. The form can be removed from a cured, formed beam structure either by opening the top beam and lowering the form or by opening the soffit panel and lifting the form.

27 Claims, 8 Drawing Sheets

OVER THE TOP HINGED CONCRETE FORM AND METHOD OF USING THE SAME

RELATED APPLICATION DATA

The present patent is related to U.S. provisional patent application Ser. No. 60/183,488, filed on Feb. 18, 2000.

FIELD OF THE INVENTION

The invention is generally related to structural concrete forms, and more particularly to a form and to a method of using the form for producing concrete structures wherein the form has an openable top beam.

BACKGROUND OF THE INVENTION

Concrete forms for fabricating structural concrete beams such as stadium raker beams, bridge bents or beams, and the like are well known. The self-spanning method or technique is often utilized to form such structures and is also well known. This type of form typically has opposed, spaced apart side panels, a hinged bottom soffit panel and a top opening extending along a longitudinal axis of the form. These forms also typically have a plurality of top beams arranged transverse to the longitudinal axis of the form and spanning the top opening. The top beams are fixed to the top edges of the side panels to add adding structural rigidity and to square up the form. The hinged soffit panel is openable so that the form can be removed or lifted in one piece from a cured, formed concrete section such as a stadium raker or bridge bent.

This type of concrete form requires at least partial dismantling and reassembly to a degree necessary for installation or setting of reinforcement steel within the form. The reinforcement steel can include a plurality of elongate steel rebar rods, a preformed rebar cage, or any other suitable reinforcement. The steel is set in the form through the top opening. Therefore, the top beams must be removed in order to place the steel.

The conventional manner of using this type of hinged bottom soffit panel form includes first fully assembling the form and then placing the form with a crane or other lifting device in the installation position where the raker, bent, or other concrete structure will be used. The top pieces including the top plurality of top beams must each then be removed to provide access to the top opening. The steel is set in place through the open top of the form. The top pieces are then reinstalled and secured over the top opening.

After the steel reinforcement is set in the form, the concrete is then poured or otherwise added to the form. After the concrete is sufficiently cured, the soffit panel is opened or dropped and the form is lifted in one piece from the cured concrete structure and either placed on the ground or at a new installation position. To subsequently use the form at a different installation position, it must again be partly dismantled to the degree necessary to set new steel reinforcement elements therein and then be reassembled again. This process is time consuming and can therefore add significantly to both labor cost and construction time.

It is also possible, as an alternative, to set the steel in the form for each use while the form is on the ground. The fully assembled form and installed steel reinforcement can be lifted together to the installation position. However, each subsequent use of the form still requires the time consuming process of dismantling all top pieces in order to set new steel in the form. Further, the steel reinforcement adds significant weight to the form. Lifting the form and steel together will likely increase the required size and load capability of the crane. This can add significant cost to a particular job.

BRIEF DESCRIPTION OF THE DRAWINGS

Exemplary concrete forms and methods in accordance with the teachings of the present invention are described and explained in greater detail below with the aid of the drawing figures in which.

DETAILED DESCRIPTION OF THE PREFERRED EMBODIMENTS

Figure 1:
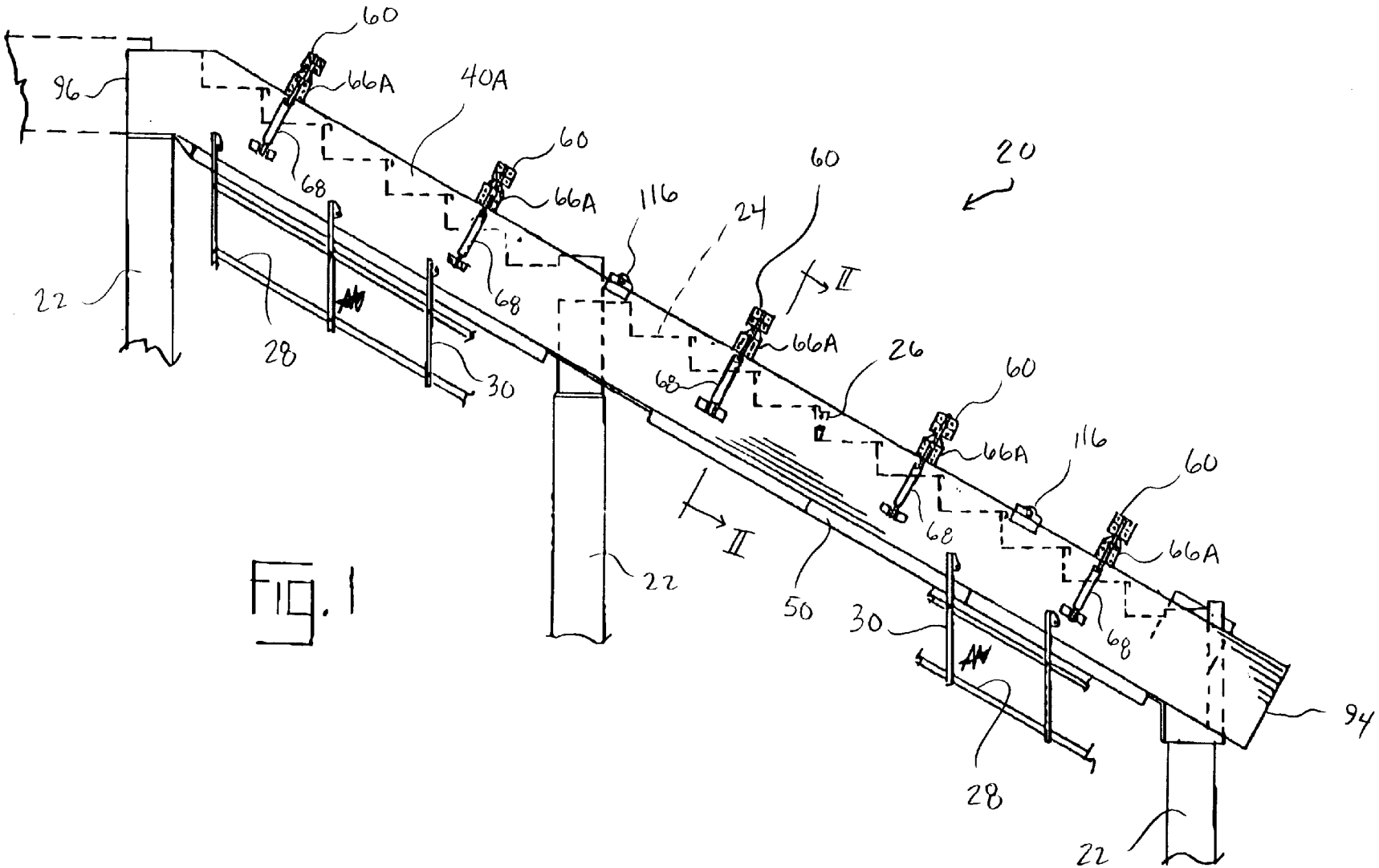
FIG. 1 is a side view of one example of a form that is constructed according to the teachings of the present invention and that is for forming a stadium raker concrete structure.

Referring now to the drawings, FIG. 1 is a side view of a concrete form constructed according to the teachings of the present invention. The disclosed concrete form 20 in this example is for forming a concrete support structure in the form of a stadium raker. In general, the stadium raker form 20 is shown after being set in place at an installation position on a plurality of supports or columns 22 as is known in the art. The type and construction of the columns 22 can vary considerably as required for a particular construction project. As illustrated in FIG. 1, multiple columns 22 are typically required for supporting the form 20 and the later-formed concrete structure such as the stadium raker. One or more of the columns 22 can either be a temporary support or can be a permanent pre-formed concrete support that will be at least partly embedded in (see FIG. 8) or supportive under the concrete structure after its formation.

The stadium raker form 20 shown in FIG. 1 is raked, or in an inclined orientation. The disclosed form 20 produces a raked structure that is typically utilized to support, along with other such rakers, precast stadium seating sections which are inclusive of steps. The raker is therefore also formed having a plurality of steps 24 (shown in phantom in FIG. 1). Steps are not required for many concrete structures of this type (see FIGS. 6–8 herein). To produce the steps 24, a plurality of fixed, vertically oriented risers 26 can be mounted within the form 20 providing spaced apart vertical barriers in the form to mold the steps 24.

Figure 2A:
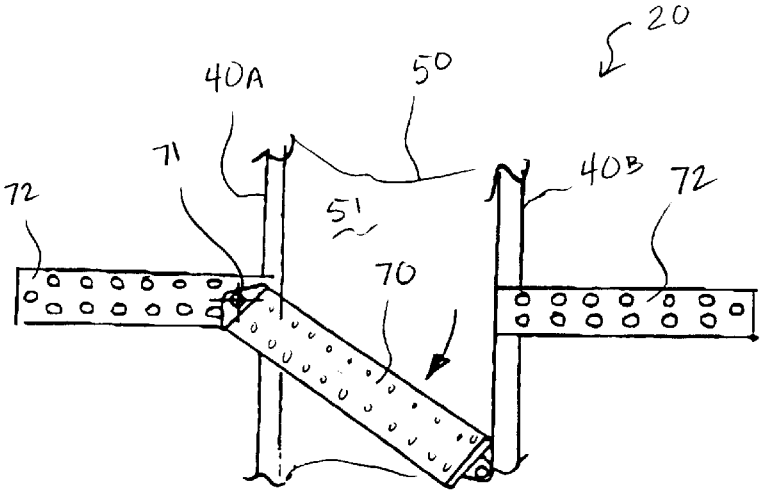
FIG. 2 is a cross section taken along line II—II of the form shown in FIG. 1 and further illustrating an openable top soldier beam and an openable bottom soffit panel.
Figure 2:
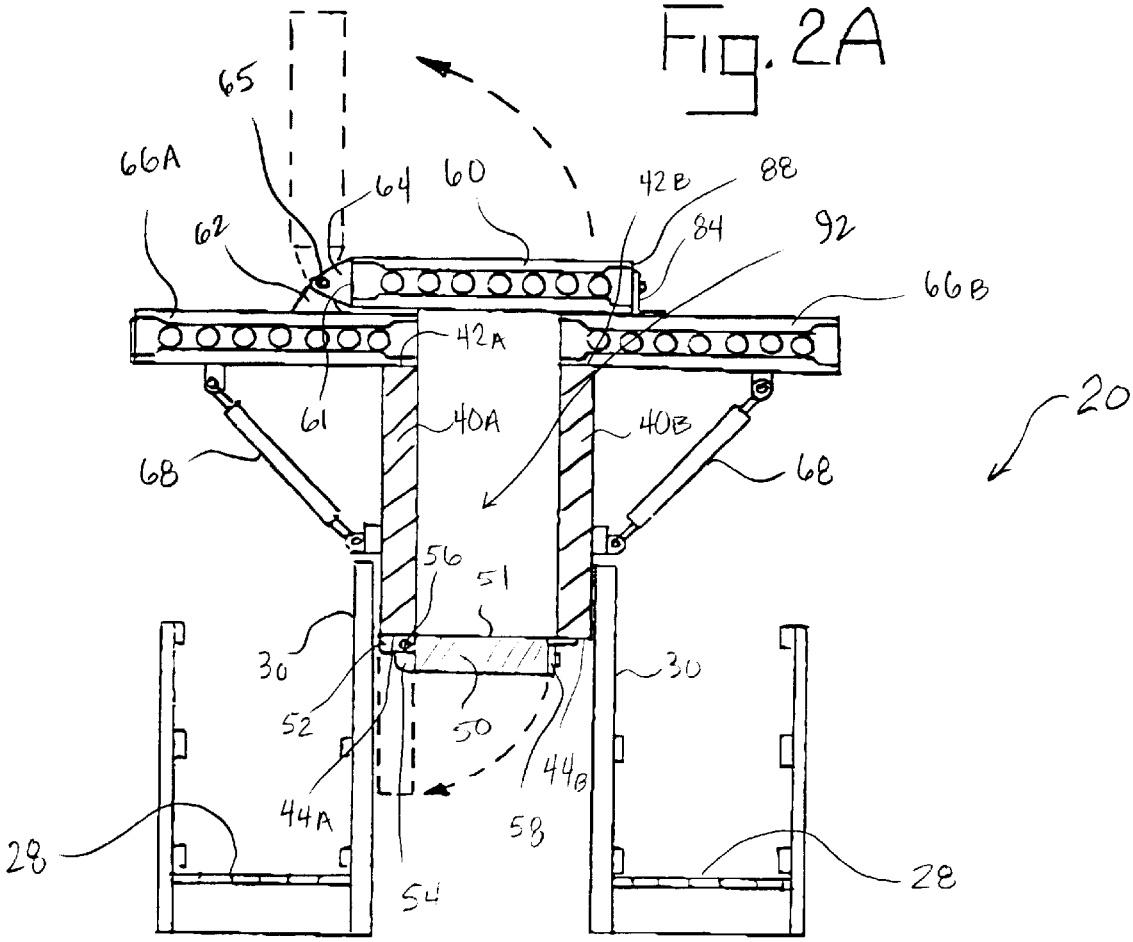

Also as shown in FIGS. 1 and 2, the form 20 can include one or more walkways 28 secured to portions of the form. The walkways permit workers to access various areas and parts of the form for installing, removing, and dismantling the form 20, when necessary. The walkways 28 can also vary considerably in configuration, location, and construction. The walkways 28 in this disclosed example are affixed to the form, such as by a plurality of suspension brackets 30. However, the suspension brackets 30 or other securing and supporting hardware must be properly positioned, whether above, on the side, or below the form 20, so as to permit lifting the form (see FIG. 5) from a cured structure according to the methods of the invention disclosed and described below.

Referring again to FIGS. 1 and 2, the disclosed form 20 has a pair of opposed, upstanding side panels 40A and 40B that are spaced apart from one another. Each of the side panels has an upper edge 42A and 42B and a lower edge 44A and 44B, respectively. A top opening 46 is defined between the side panel upper edges 42A and 42B and a bottom opening 48 is similarly defined between the lower edges 44A and 44B. As is known to those having ordinary skill in the art, the side panel material and construction can vary considerably and yet perform the intended function. For example, the side panels can be made from plywood or from a specialized from material such as Max-A-Form® panels available from the assignee of the present invention. Further, the side panels 40A and 40B can be retained to one another in any suitable manner as well. A metal lattice framework or a plurality of brackets and fasteners are typically used. Also, the side panels 40A and 40B can each be constructed from a single elongate integral element or as a plurality of panel elements arranged end to end, depending upon the chosen materials and length of the form 20. The abutting side panel elements can be secured together using fasteners and brackets or other suitable means to form the side panels 40A and 40B.

The bottom opening 48 is covered by an openable bottom soffit panel 50. Similar to the side panels or panels 40A and 40B, the soffit panel 50 can be formed as a single elongate panel or as a plurality of panels arranged in end to end abutment along the form 20 as needed. The description herein refers to one bottom soffit panel 50 although a number of soffit panels can be utilized which function in the same manner as the described single soffit panel.

The bottom soffit panel 50 has a hinge attachment to the form 20 so that the panel can be moved or pivoted between a first closed position closing off the bottom opening 48 and a second open position (shown in phantom in FIG. 2) providing access to the bottom opening. In one example, the hinge attachment is accomplished by providing one or more hinge brackets 52 carried on or near the lower edge of one of the side panels such as the lower edge 44B. One or more complimentary hinge brackets 54 can be carried on one edge 55 of the soffit panel. The hinge brackets 54 pivotally couple with the hinge brackets 52 to permit the bottom soffit panel 50 to swing about a hinge axis 56 downward from the closed position to the open position.

As will be evident to those having ordinary skill in the art, the hinge brackets 52 and 54, as well as the location of the hinge axis, can vary and yet function as intended. For example, the hinge brackets 52 that are carried by the form 20 need not be mounted directly to the lower edge of a side panel. Instead, the brackets 52 can be mounting to a separate bracket or other part of the form spaced from the lower edge as needed for a particular soffit configuration or form construction. Similarly, the hinge brackets 52 and 54 can themselves take on various configurations and constructions and yet perform as intended within the scope of the present invention.

In any case, the hinge axis 56 in the disclosed example runs parallel to the lower edges 44A and 44B of the side panels 40A and 40B. The soffit panel 50 has an interior surface 51 that must, at a minimum, be parallel and co-planar with an interior surface such as a surface 45B for the side panel 40B when in the open position. The interior surface 51 of the soffit panel 50 can also be disposed laterally outward beyond the bottom opening 48 when in the open position. However, the soffit panel must not interfere with the bottom opening when in the open position so that the form 20 to be lifted of in one piece from a cured structure. The soffit panel 50 cannot inhibit this feat when opened.

A plurality of L-shaped brackets 58 or other suitable hardware can be fastened to a corner or an edge 59 of the soffit panel 50 opposite the hinges. The brackets 58 can receive conventional fasteners to secure the soffit panel 50 in the closed position when necessary. As will be evident to those of ordinary skill in the art, the securing brackets and the bracket location can vary from the disclosed L-shaped brackets 58 and yet function adequately to removably secure the soffit panel in the closed position.

The form 20 in each of the examples shown in FIGS. 2 and 2A has at least one openable top beam. In this example, the top beam is a soldier beam 60. In most examples, the form 20 will have a plurality of top beams spaced apart over the length of the form. The number, size, type, and spacing of the top beams can vary considerably depending upon the needs of a particular job. A soldier beam is known to provide structural rigidity for the form when secured in place and yet provide flexibility in mounting method and location. Further, a soldier beam is known to be lighter in weight than some other beams such as the I-beams or stability beams discussed below.

The disclosed soldier beam 60 is also hinged about one end or corner 61 and movable between a closed position spanning the top opening 46 and an open position (shown in phantom in FIG. 2.) providing unobstructed access to the top opening. A hinge bracket 62 is carried on a portion of the form 20 for each of the top soldier beams 60. A complimentary hinge bracket 64 is carried on the one end 61 of each of the top soldier beam 60. The hinge brackets 62 and 64 cooperate together to define a hinged connection at a hinge axis 65 so that the top beam 60 can be opened and closed. Again, the hinge brackets 62 and 64 and the pivot axis 65 can be constructed and arranged having various placements relative to the form 20 and having various constructions, as long as the top soldier beam 60 can span the top opening 46 and be secured in place in the closed position and can be pivoted out of the way as necessary.

It is known to those of ordinary skill in the art that the side panels 40A and 40B and the bottom soffit panel 50 must remain substantially square relative to one another. The loads borne by the components of the form 20 that are created by the poured concrete and the sheer mass of the form components are very significant. If the form panels do not remain substantially square to one another, the form (viewed in cross section such as in FIG. 2) will structurally fail. The disclosed example of a form with hinged top beams therefore has an added structural element to assist in keeping the panels square.

The disclosed stadium raker form 20 has a pair of fixed soldier beams 66A and 66B associated with each top hinged soldier beam 60. The fixed beams 66A and 66B are arranged transverse to the form longitudinal axis and perpendicular or normal to a respective one of the side panels 40A and 40B.

The fixed beams 66A and 66B are generally parallel to and co-linear with one another and a corresponding one of the top beams 60 is parallel with the pair of fixed beams and rests on their respective top surfaces spanning the top opening 46. A proximal end 67A and 67B, respectively, of each fixed soldier beam 66A and 66B rests on a corresponding top edge of the respective side panel 40A and 40B. The proximal ends are spaced apart at least the width of the top opening 46. Each fixed beam extends laterally outward from its respective side panel. The proximal end 67A and 67B of each fixed soldier beams 66A and 66B can be suitably secured by brackets and fasteners to corresponding upper edges 42A and 42B of the side panels.

A pier cap brace 68 is affixed at one end to the appropriate side panel and affixed at an opposite end to the underside of a corresponding fixed soldier beam. A brace 68 is suitably mounted for each of the fixed soldier beams 66A and 66B. The braces provide some support for the distal ends of the fixed beams. However, the braces are more importantly utilized to square up the form cross section and to hold the configuration. The braces 68 can therefore be length adjustable to assist in squaring up the form once assembled.

In this example, the form hinge bracket 62 for each top soldier beam 60 is secured to a top surface of one of the corresponding pair of fixed soldier beams, such as the beam 66A. In this example, the hinge axis 65 is spaced laterally outward from the position of the corresponding side panel 40A. This is so that the top soldier beam, when in the opened position, provides ample room for workers to set the steel reinforcements, as describe below.

FIG. 2A discloses an alternative example of an arrangement for permitting movement of the top soldier beams 60 between the open and closed position. In some concrete form constructions such as the raker form 20 illustrated in FIG. 1, the one or more top beams 60 can have substantial mass. The heavy, massive beams can be very difficult to lift and pivot upward, especially if they are of substantial length across the form. The example shown in FIG. 2A provides an alternative to the hinged connection shown in FIG. 2 to overcome this potential problem in some forms. The form 20 in FIG. 2A has a top soldier beam 70 and a vertical axis pivot 71 at one corner or end 72. The pivot couples the beam corner or end 72 to a portion of the form such as the fixed soldier beam 66A. In this example, the top soldier beam defines a plane "TP" in the closed position (see FIG. 2). To move the top soldier beam 70 to the open position, the top soldier beam 70 is rotated about the pivot 71 while remaining in the plane "TP" whether in the open or closed position. Again, the location and construction of such a pivot arrangement can vary considerably as long as the top soldier beam 70 can move between the open and closed positions.

Referring again to FIG. 2, a plurality of securing brackets 84 can also be mounted to the top soldier beam 60 or to the form 20, as shown. The securing brackets 86 are positioned adjacent a top soldier beam free end or corner 88. When the top soldier beam 60 is rotated to the closed position, the securing brackets 84 can be used to secure the top soldier beam in place across the top opening 46. In this example, the brackets 84 are mounted to the fixed soldier beam 66B. Fasteners can be passed through the brackets and into the top soldier beam to secure the panel in the closed position. As will be evident to those having ordinary skill in the art, other constructions and arrangements can be used to releasably secure the top soldier beam in place.

Figure 3:
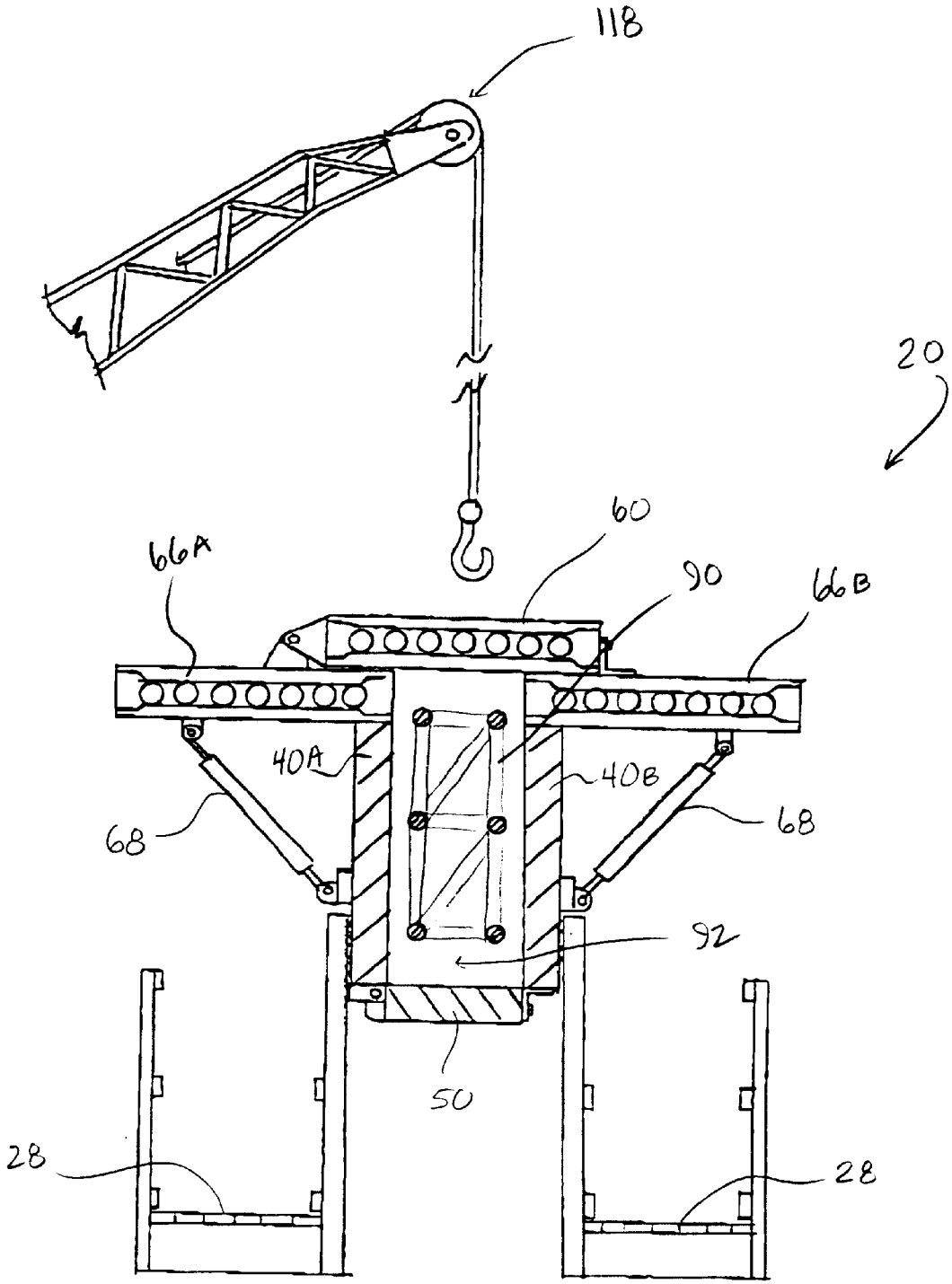
FIG. 3 is a cross section as shown in FIG. 2 and after a steel reinforcing rebar cage has been set in the form.
Figure 4:
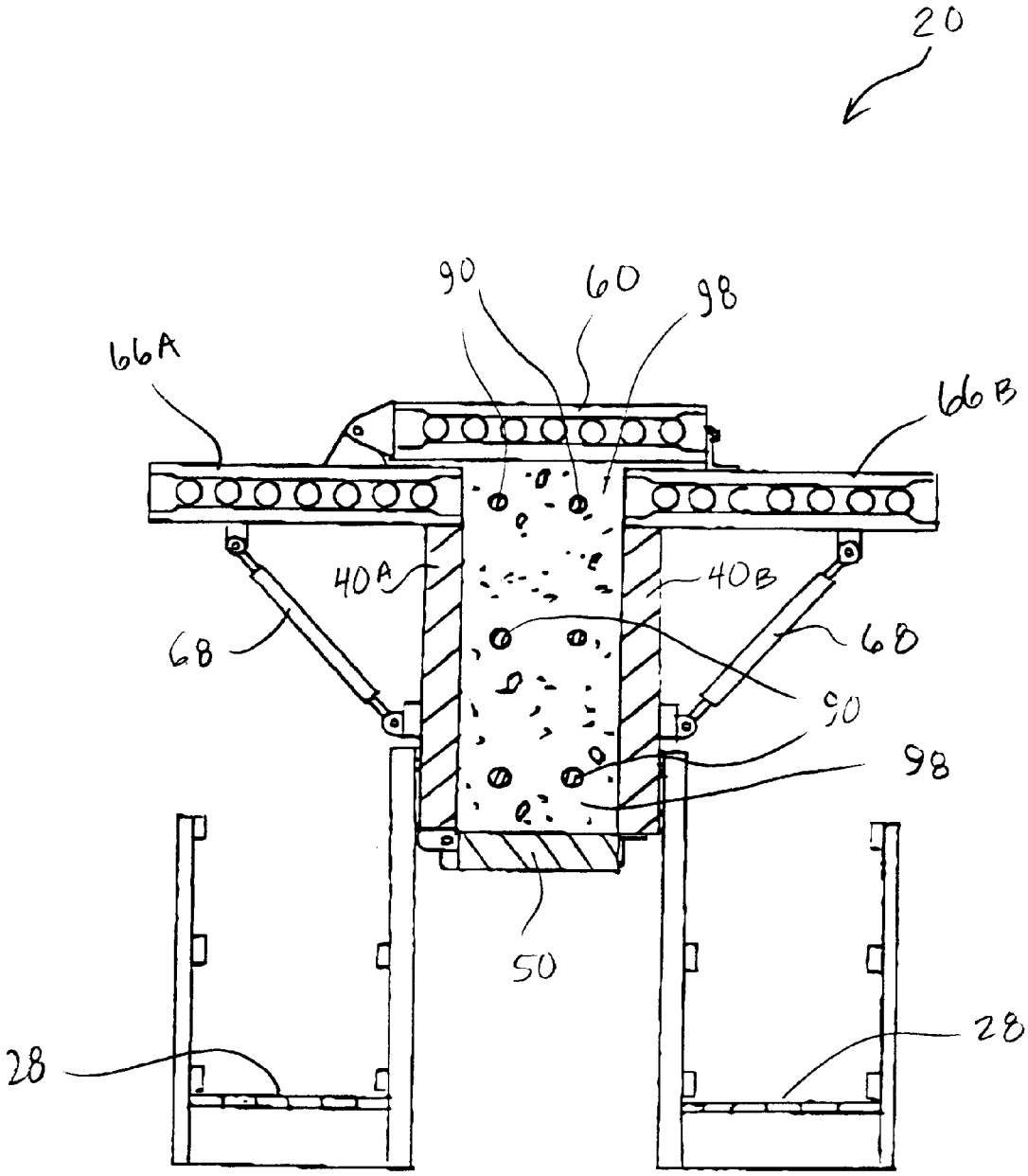
FIG. 4 is a cross section as shown in FIG. 3 and after concrete has been added to the form.
Figure 5:
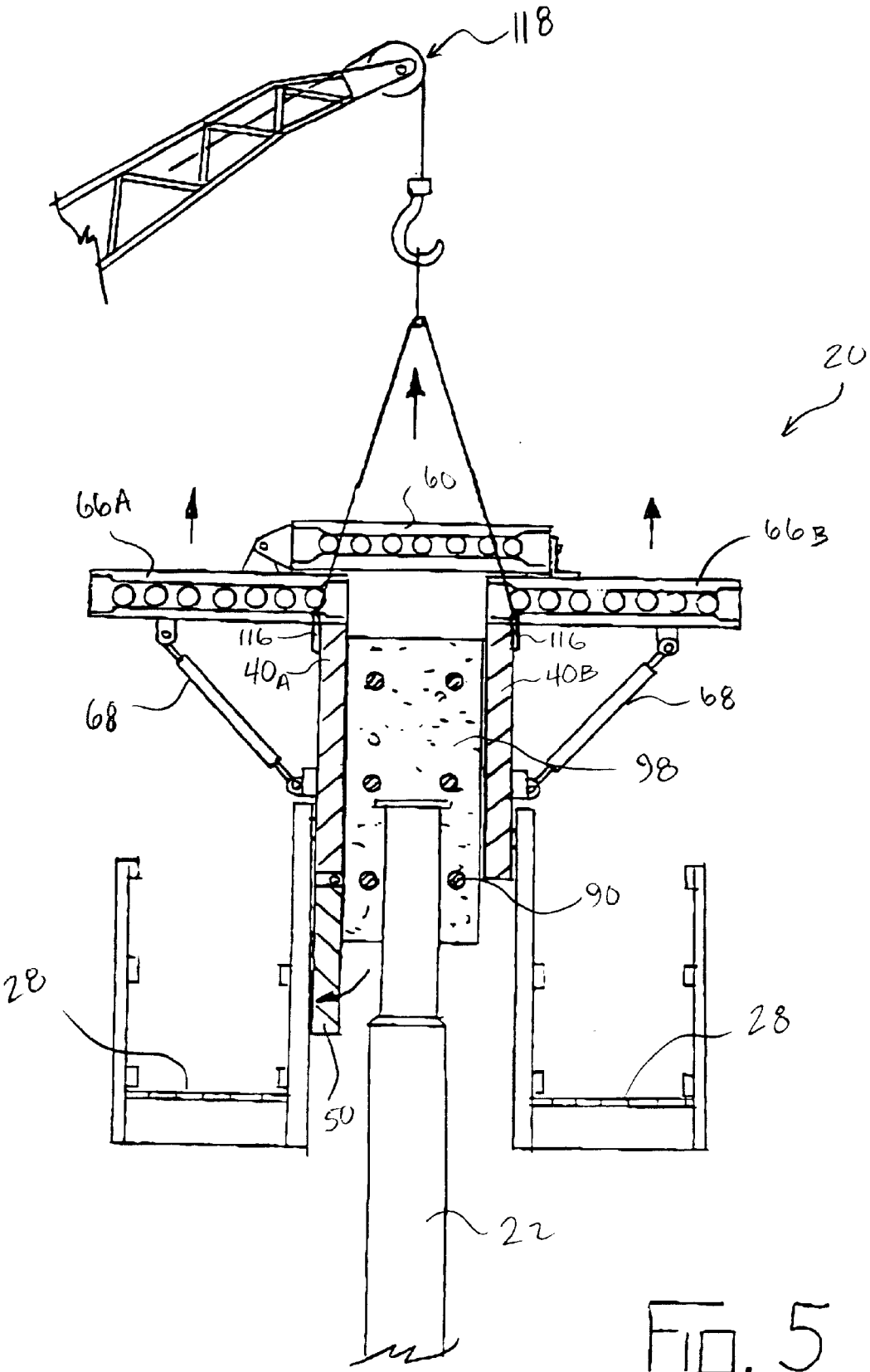
FIG. 5 is a cross section as shown in FIG. 4 and as the form is being lifted from the cured concrete.

FIG. 3 shows at least one steel reinforcement element 90, such as a rebar cage or a plurality of rebar rods, positioned or set within the form 20 prior to pouring the concrete. The form 20 defines a forming space 92 within the panels that shapes the contour for the cured structure. The forming space 92 of the form 20 is defined by the interior surfaces of the side panels 40A and 40B and the one or more soffit panels 50. The steel reinforcement elements are commonly known and used to add significant tensile strength to concrete elements. The reinforcement elements 90 can vary considerably in size, shape, and quantity, depending upon the particular construction element being formed. FIG. 4 shows the same form cross section after concrete 98 has been poured in or added to the forming space 92. FIG. 5 shows the form 20 being lifted from the concrete after it has been cured as described below.

Figure 6:
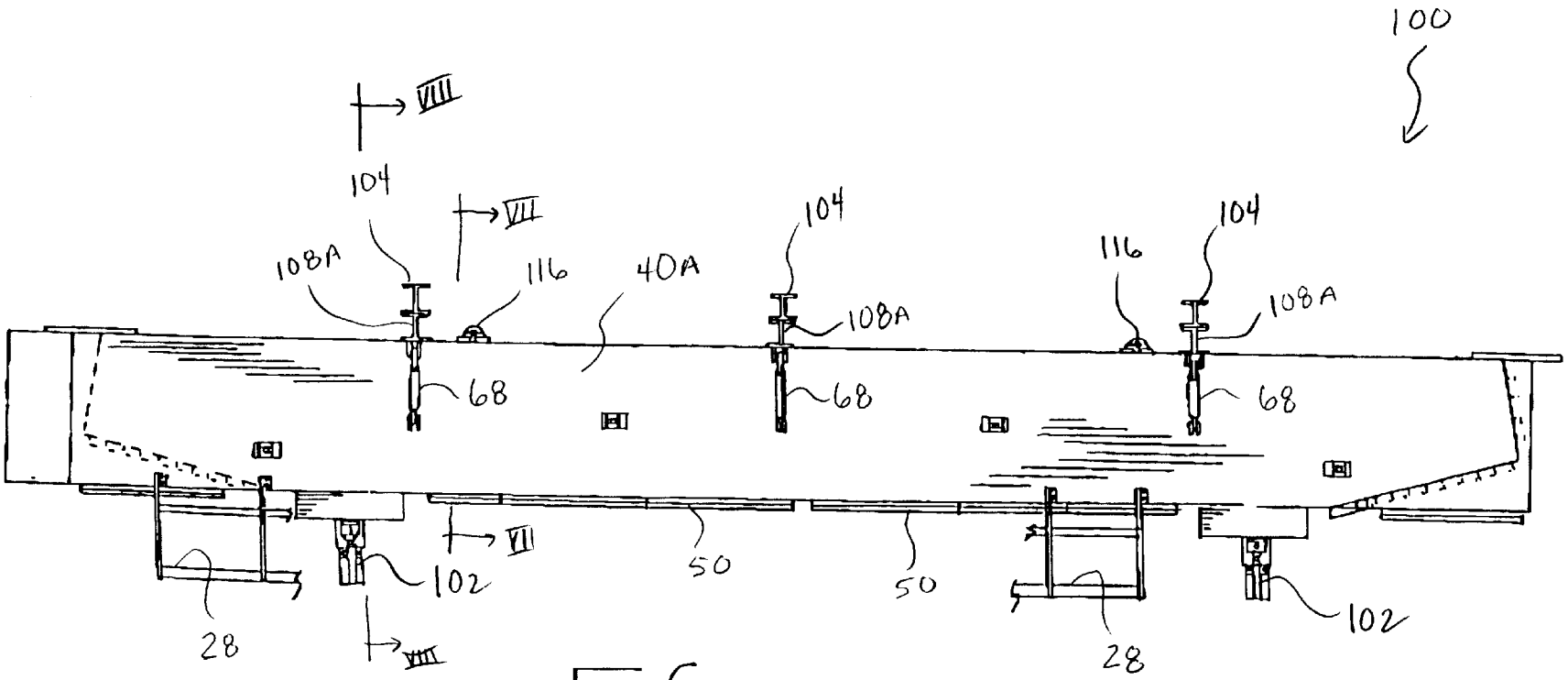
FIG. 6 is a side view of another example of a form that is constructed according to the teachings of the present invention and that is for forming a roadway bridge bent concrete structure.
Figure 7:
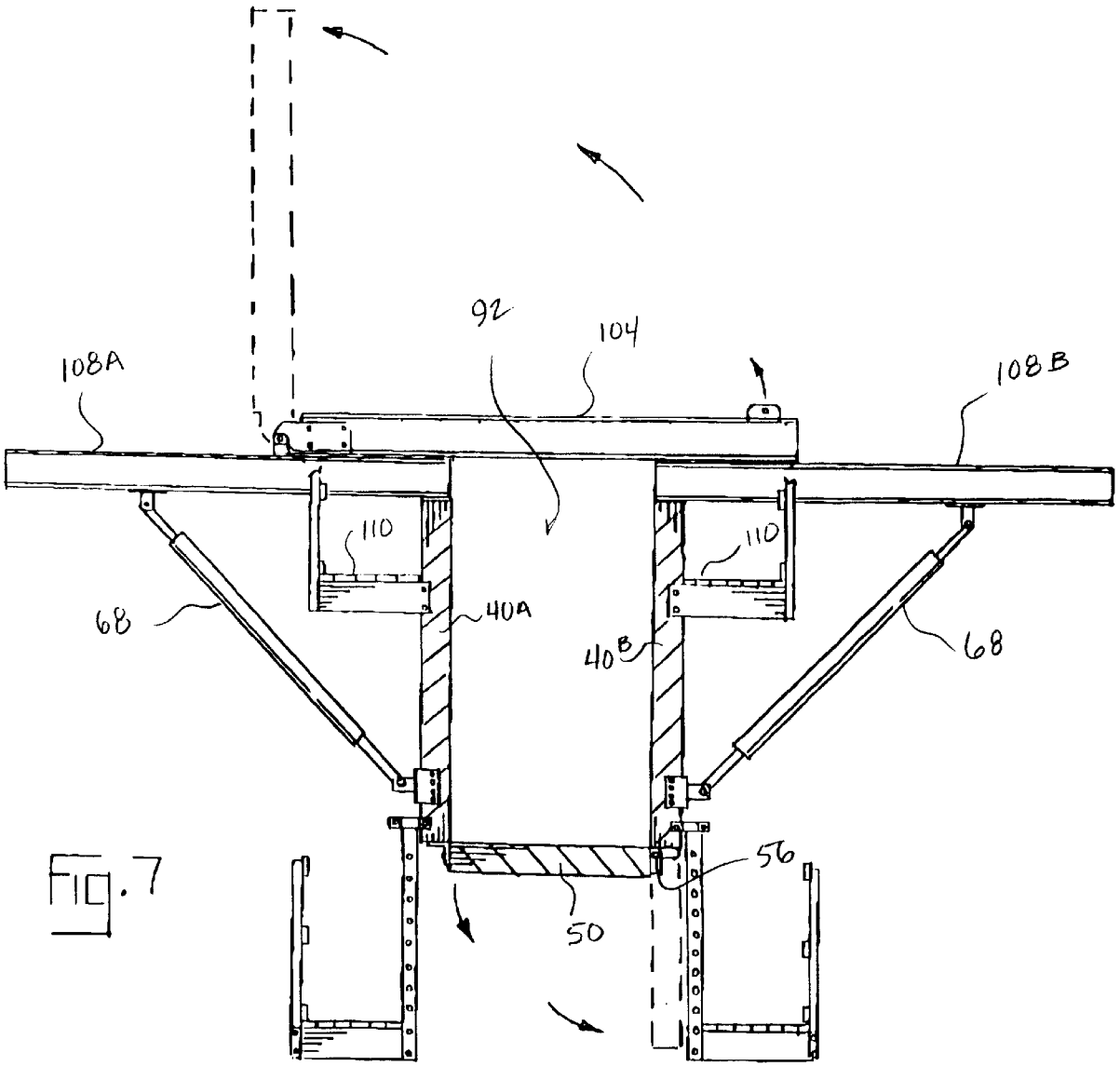
FIG. 7 is a cross section taken along line VII—VII of the form shown in FIG. 5 and further illustrating an openable top stability beam and an openable bottom soffit panel.
Figure 8:
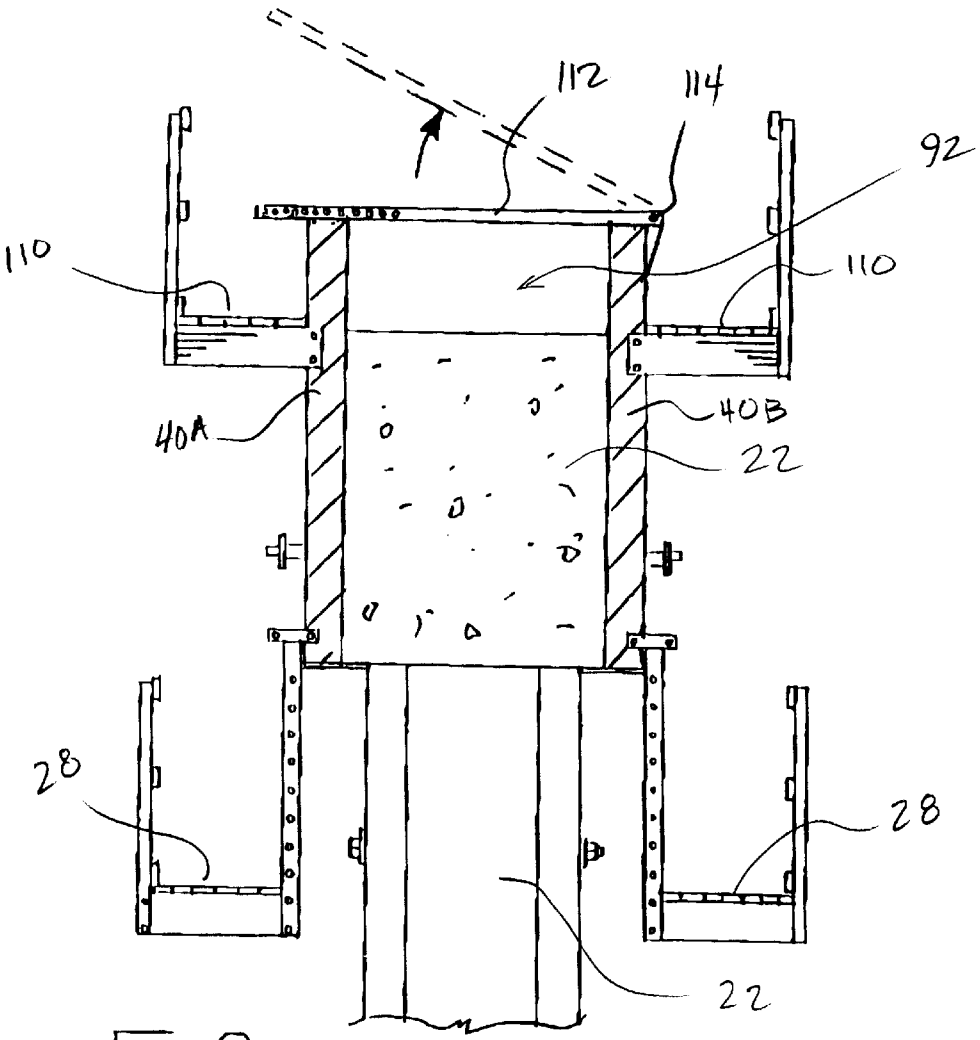
FIG. 8 is a cross section taken along line VIII—VIII of the form shown in FIG. 5 and further illustrating an openable top tie.

FIGS. 6–8 illustrate another example of a concrete form 100 which in this example is an elevated highway bridge bent. The bridge bent form 100 again is supported by a plurality of supports or columns 102 when in the installed position. The supports or columns can again vary considerably, similar to the prior described columns 22. In this example, no risers 30 are needed since the form will provide a concrete construction element that is generally flat on the top, bottom, and both sides and is generally used to support steel or concrete beams that further support a concrete deck surface. Many of the elements shown in FIGS. 6–8 are essentially the same as corresponding elements in the prior described form 20 and are therefore given the same reference number herein.

The example of FIGS. 6–8 includes one or more top stability beams 104 in the form of I-beams that are substituted for the soldier beam construction in the prior disclosed example. The top stability beams 104 of this example are arranged transverse to the form longitudinal axis and are hinged in a manner substantially similar to the soldier beam 60 in the prior example. The top stability beam 104 can again be pivoted (similar to soldier beam 60 in FIG. 2) or rotated (similar to soldier beam 70 in FIG. 2A) between an open and a closed position as shown in FIG. 7. The form 100 also includes a plurality of pier cap braces 68 that extend from the side panels 40A and 40B. Each pier cap brace 68 attaches to an under side of one of a pair of fixed stability beams 108A and 108B. The fixed stability beams 108A and 108B extend from the side panels perpendicularly similar to the fixed soldier beams 66A and 66B in the prior example. The hinged top stability beam 104 rests on the two fixed stability beams 108A and 108B across the top opening. In this example, an optional secondary walkway 110 is also shown on each side of the form 100 adjacent the outer surface of the side panels 40A and 40B and directly beneath the fixed stability beams 108A and 108B. These additional walkways 110 provide access for construction workers to various areas of the form as necessary.

FIG. 8 shows another cross section of the form 100. The form 100 can also include a plurality of top ties 112 which extend laterally between the side panels 40A and 40B spanning the top opening 46. In this example, each top tie 112 is pivotally coupled by a hinge 114 to the top edge 42A of the side panel 40A at one end and can be moved between open and closed positions. Each of the top ties 112 can also be secured in place at its free end to the top edge 42B of the opposite side panel 40B to provide structural rigidity to the forms 20 or 100 once assembled. The top ties 112 and hinges 114 can again vary considerably in configuration and construction and yet fall within the scope of the present invention.

As will be evident to those having ordinary skill in the art, other concrete structures can be created using a form with the disclosed hinged top beams and a hinged bottom panel, though the form differs from the disclosed exemplary raker or bridge bent forms. However, in each particular case, both the one or more bottom soffit panels 50 and the one or more top beams 60 or 104 will be moveable between open and closed positions for selectively providing access to the top and bottom openings as needed to perform the methods of the invention described below.

The various methods are described herein utilizing the disclosed exemplary stadium raker form 20 shown in FIGS. 1 and 2 and in conjunction with FIGS. 3–5. However, the disclosed methods are equally suitable for the form 100 or other over the top hinged forms, though not disclosed in detail herein.

In use, the form 20 can be substantially completely assembled either on the ground at a work site, in a remote manufacturing facility, or directly on the columns 22 at the final installation position. The form 20 can also be virtually completely assembled at any of these locations, with or without setting the steel reinforcement elements 90 within the forming space 92. The openable top beam configuration permits such flexibility.

The form 20 can be either remotely assembled and then placed on the columns 22 or can be assembled directly on the columns 22. Each of the one or more top beams 60 (and each top tie 112, if present) is unsecured and rotated about the hinge axis 65 to the open position providing unobstructed access through the top opening 46 into the forming space 92. The steel reinforcement elements 90 can then be appropriately placed and secured as needed within the forming space 92 (see FIG. 3). Thus, the reinforcing elements 90 can be placed after near complete assembly of the form and without the need to completely remove top ties and top beams. Further, the elements 90 can also be set either before or after placement of the form 20 in the installation position on the columns 22.

Once the steel reinforcement elements 90 are placed within the forming space 92, each of the top beams 60 (and top ties 112, if present) is then moved to the closed position closing off the top opening 46. Each of the top beams 60 can then be secured in the closed position utilizing the plurality of securing brackets 84.

Once closed, the forming space 92 can be appropriately filled with uncured concrete (see FIG. 4). The concrete can be placed through the top opening between to ties and top beams as is known to those having ordinary skill in the art. The form 20 then remains in place until the concrete is sufficiently cured. The one or more soffit panels 50 are then released upon curing from the securing brackets 58 and pivoted downward to the open position. The form 20 can include a plurality of lift lugs 116 suitably attached to a portion of a crane 118 such as on the top edges 42A and 42B of the side panels (see FIGS. 1 and 6). The crane 118 can then be used to lift the entire assembled form 20 in one piece from the cured concrete 98 (see FIG. 5). As noted above, the soffit panel or panels 50 must not encroach upon the width of the forming space or the bottom opening 48 as shown in FIG. 5. The form must be lifted without obstruction by the bottom soffit panel 50 from the cured concrete 98. In addition, the top beam hinge axis 65 can be sufficiently spaced outward from the top opening to provide additional clearance for workers and equipment as needed while the top ties and beams are open.

In this disclosed method, the form 20 can both be set in the installation position and can be stripped from the cured form in one piece. The form 20 can be so utilized whether the particular application requires reinforcing steel therein. The form 20 can also remain assembled for subsequent uses at different installation positions. Some applications may require the steel to be placed after the form is set in an installation position. In such applications, it is very often difficult or impossible to assemble and/or set the form in place and then install the reenforcing steel in the forming space. Other applications may require that reinforcing steel be placed into the form prior to being set in the installation position. The disclosed forms permit the reinforcing steel to be placed in the form before or after being set in the installation position with very little difficulty.

In another example, the hinged top beams 60 (and top ties 112, if present) can be opened upon curing of the concrete 98 and provide for, if necessary, stripping the form downward in one piece. The concrete 98 of the cured structure would slip through the opened top opening 46 instead of slipping through the bottom opening 48.

In a further example, the form can be substantially completely assembled remote from the columns 22 at the installation position. Reinforcement steel 90 can then be added to the forming space 92 by simply opening the top beams 60 (and top ties 112, if present). After placement of the reinforcing steel, the entire form and steel can be lifted into place utilizing a crane 118 and set in the installation position on the columns 22. However, the disclosed form permits placement of the reinforcement steel without substantially dismantling the top of the form. Therefore the form 20 can be used at a first installation position and then used at one or more subsequent installation positions without having to substantially dismantle the form.

To illustrate, the form 20 permits moving and reuse of the form for a second installation position to fabricate a second concrete structure without dismantling the form. The form can be stripped in one piece from the first cured structure as described above, and then set either on the ground or in the second installation position. By simply opening the top beams 60 (and top ties 112, if present), reinforcement steel 90 can again be placed in the forming space 92. Subsequent steps are then repeated for producing the concrete structure at the second installation position.

Although certain methods and concrete forms have been disclosed and described herein in accordance with the teachings of the present invention, the scope of coverage of this patent is not limited thereto. On the contrary, this patent covers all embodiments of the teachings of the invention fairly falling within the scope of the appended claims, either literally or under the doctrine of equivalents.

What is claimed is:

1. A concrete form for fabricating a concrete structure, the concrete form comprising:

a pair of opposed upstanding and spaced apart side panels having a forming space between the side panels, each side panel having a respective upper edge and a respective lower edge, whereby a top opening is defined between the upper edges and a bottom opening is defined between the lower edges;

at least one bottom soffit panel coupled to the concrete form and movable between a first soffit position closing off the bottom opening and a second soffit position providing access to the forming space through the bottom opening; and at least one movable top beam coupled to the concrete form and movable between a first top beam position traversing the top opening and a second top beam position providing access to the forming space through the top opening while remaining coupled to the concrete form.

2. A concrete form according to claim 1, wherein the at least one movable top beam has a first end attached by at least one upper hinge defining an upper hinge axis, and wherein the at least one movable top beam is pivotable about the upper hinge axis between the first and second top beam positions.

3. A concrete form according to claim 1, wherein the at least one soffit panel has a first edge arranged generally parallel to and attached by at least one lower hinge defining a lower hinge axis along one of the side panel lower edges, and where the at least one soffit panel is pivotable about the lower hinge axis between the first and second soffit positions.

4. A concrete form according to claim 1, further comprising a plurality of the movable top beams arranged spaced apart over a length of the concrete form and generally parallel to one another.

5. A concrete form according to claim 1, wherein the at least one movable top beam defines a top beam plane and is pivotally attached at one end to a portion of the form near one of the side panel upper edges laterally beyond the top opening, wherein the at least one movable top beam is pivotable about the one end within the top beam plane between the first and second top beam positions.

6. A concrete form according to claim 5, further comprising a plurality of the movable top beams arranged spaced apart over a length of the concrete form.

7. A concrete form according to claim 1, wherein the at least one movable top beam is selected from at least one of an I-shaped stability beam and a soldier beam.

8. A concrete form according to claim 1, further comprising:

a pair of fixed top beams, one each arranged generally normal to a respective one of the side panels and extending outward from the top edge relative to one another, wherein the at least one movable top beam rests on a portion of each of the pair of fixed top beams; and a pair of braces, one each attached and extending between a respective one of the side panels and a respective one of the pair of fixed top beams.

9. A method of forming concrete structures, the method comprising the steps of:

placing a concrete form supported at a first installation location, the concrete form having a pair of opposed side panels and at least one openable bottom soffit panel, wherein the side panels and the at least one soffit panel together define a forming space within the concrete form, the concrete form also having at least one transverse top beam movable between an open position and a closed position, wherein the at least one transverse top beam remains coupled to the concrete form in both the open and closed positions;

installing at least one steel reinforcing element within the forming space through a top opening in the concrete form that is accessible when the at least one transverse top beam is in the open position;

closing and securing the at least one top beam;

filling the forming space with uncured concrete;

subsequently curing the uncured concrete to form a first one of the concrete structures; and subsequently removing the concrete form from the first one of the concrete structures.

10. A method according to claim 9, wherein the step of removing the concrete form further comprises the steps of:

opening the at least one bottom soffit panel; and lifting the concrete form from the first one of the concrete structures.

11. A method according to claim 9, wherein the step of removing the concrete form further comprises the steps of:

opening the at least one transverse top beam; and lowering the concrete form from the first one of the concrete structures.

12. A method according to claim 9, wherein the step of placing further comprises:

assembling the concrete form at the first installation location.

13. A method according to claim 9, further comprising the steps of:

assembling the concrete form with the at least one transverse top beam in the closed position; and opening the at least one transverse top beam after the step of placing and before the step of installing.

14. A method according to claim 9, further comprising the step of:

dismantling the concrete form after the step of removing.

15. A method according to claim 9, further comprising the steps of:

after the step of removing, moving the concrete form to a second installation location;

placing the concrete form supported at the second installation location;

re-opening the at least one transverse top beam; and repeating the steps of installing, closing, filling, curing, and removing to form a second concrete structure.

16. A method according to claim 9, wherein the step of opening the at least one transverse top beam further comprises:

pivoting the at least one transverse top beam about a hinge axis oriented generally parallel to an upper edge of one of the side panels.

17. A method according to claim 9, wherein the step of opening the at least one transverse top beam further comprises:

rotating the at least one transverse top beam within a top beam plane about a vertically oriented pivot axis positioned near an upper edge of one of the side panels beyond a top opening of the form.

18. A method according to claim 9, wherein the step of installing is performed prior to the step of placing.

19. A method of forming concrete structures, the method comprising the steps of:

assembling a concrete form having a pair of opposed side panels and at least one openable bottom soffit panel, wherein the side panels and the at least one bottom soffit panel when closed together define a forming space within the concrete form, the concrete form also having at least one transverse top beam movable between an open position and a closed position, wherein the at least one transverse top beam remains coupled to the concrete form in both the open and closed positions;

installing at least one steel reinforcing element within the forming space through a top opening that is accessible when the at least one transverse top beam is in the open position;

closing and securing the at least one transverse top beam across the top opening;

placing the concrete form supported at a first installation location;

filling the forming space with uncured concrete;

curing the uncured concrete to form a first one of the concrete structures; and removing the form from the first one of the concrete structures.

20. A method according to claim 19, wherein the step of removing the concrete form further comprises the steps of:

opening the bottom soffit panel; and lifting the form from the cured concrete.

21. A method according to claim 19, further comprising the steps of:

after the step of removing, placing the concrete form on a ground surface;

moving the at least one transverse top beam to the open position;

installing at least one steel reinforcement element within the forming space;

placing the concrete form in a second installation location where a second one of the beam structures is to be utilized; and repeating the steps of adding, curing, and removing for the second one of the concrete structures.

22. A method according to claim 19, further comprising the step of:

dismantling the concrete form after the step of removing.

23. A method of setting up a concrete form, the method comprising the steps of:

assembling a concrete form having a pair of opposed side panels and at least one openable bottom soffit panel, wherein the side panels and the at least one bottom soffit panel when opened together define a forming space within the concrete form, the concrete form also having at least one transverse top beam movable between an open position and a closed position, wherein the at least one transverse top beam remains coupled to the concrete form in both the open and closed positions;

installing at least one steel reinforcing element within the forming space through a top opening in the concrete form that is accessible when the at least one transverse top beam is in the open position; and closing and securing the at least one transverse top beam across the top opening.

24. A method according to claim 23, further comprising the step of:

placing the concrete form in a first installation position where a concrete structure is to be utilized after performing the step of assembling the concrete form.

25. A method according to claim 24, further comprising the steps of:

closing and securing the at least one transverse top beam before the step of placing; and opening the at least one transverse top beam before the step of installing.

26. A method according to claim 23, wherein the step of assembling is performed at a first installation position where a concrete structure is to be utilized and prior to the step of installing.

27. A method according to claim 23, further comprising the steps of:

installing the at least one steel reinforcement element after the step of assembling; and subsequently placing the concrete form in a first installation position where a concrete structure is to be utilized.

* * * * *